US006415917B1

(12) United States Patent
Marco

(10) Patent No.: US 6,415,917 B1
(45) Date of Patent: Jul. 9, 2002

(54) TOP LIFT HANDLE CONTAINER CARRIER

(75) Inventor: Leslie S. Marco, Bloomingdale, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/616,294

(22) Filed: Jul. 14, 2000

Related U.S. Application Data

(63) Continuation-in-part of application No. 09/220,428, filed on Dec. 24, 1998, now Pat. No. 6,213,293, and a continuation-in-part of application No. 09/373,936, filed on Aug. 17, 1999, now Pat. No. 6,145,656.

(51) Int. Cl.[7] ..... B65D 75/00
(52) U.S. Cl. ..... 206/147; 206/434; 294/87.2
(58) Field of Search ..... 206/141, 142, 206/143, 145, 147, 150, 151, 162, 434, 427, 159, 192; 294/87.2

(56) References Cited

U.S. PATENT DOCUMENTS

| | | | | |
|---|---|---|---|---|
| 2,650,128 A | * | 8/1953 | Failor | 294/87.2 |
| 2,654,474 A | | 10/1953 | Ringler | |
| 2,701,661 A | | 2/1955 | Murray | |
| 2,946,621 A | | 7/1960 | Williamson | |
| 3,084,792 A | | 4/1963 | Poupitch | |
| 3,118,537 A | | 1/1964 | Copping | |
| 3,186,544 A | * | 6/1965 | Curry et al. | 206/151 |
| 3,198,327 A | | 8/1965 | Boehling et al. | |
| 3,200,944 A | | 8/1965 | Rapata | |
| 3,214,016 A | | 10/1965 | Stephan | |
| 3,217,874 A | | 11/1965 | Potter | |
| 3,325,004 A | | 6/1967 | Wanderer | |
| 3,330,408 A | | 7/1967 | Wanderer | |
| 3,385,626 A | * | 5/1968 | Wozniak | 206/145 |
| 3,410,596 A | | 11/1968 | Slevin, Jr. | |
| 3,460,863 A | | 8/1969 | Schaich | |
| 3,570,746 A | | 3/1971 | Wood | |
| 3,727,754 A | | 4/1973 | Cunningham | |
| 3,899,076 A | | 8/1975 | Florian | |
| 4,378,879 A | | 4/1983 | Killy | |
| 4,403,689 A | | 9/1983 | Wood | |
| 4,471,870 A | | 9/1984 | Uhlig | |
| 4,523,676 A | | 6/1985 | Barrash | |
| 4,545,480 A | * | 10/1985 | Klygis | 206/151 |
| 4,560,064 A | | 12/1985 | Peterson et al. | |
| 4,637,515 A | | 1/1987 | Wilson et al. | |
| 4,779,731 A | | 10/1988 | Fujio | |
| 4,807,751 A | | 2/1989 | Klygis et al. | |
| 4,815,589 A | | 3/1989 | Allen et al. | |
| 4,828,110 A | | 5/1989 | Lems | |
| 4,893,712 A | * | 1/1990 | Allen et al. | 206/150 |
| 4,932,528 A | * | 6/1990 | Benno | 206/432 |
| 5,261,530 A | * | 11/1993 | Marco | 206/150 |

(List continued on next page.)

FOREIGN PATENT DOCUMENTS

| | | |
|---|---|---|
| EP | 242 108 | 10/1987 |
| EP | 1 013 564 A2 | 6/2000 |
| FR | 2 015 754 | 4/1970 |
| FR | 2169442 | 9/1973 |
| GB | 2 242 675 | 10/1991 |
| WO | 93/14992 | 8/1993 |

*Primary Examiner*—Shian Luong
(74) *Attorney, Agent, or Firm*—Pauley Petersen Kinne & Erickson

(57) ABSTRACT

A container carrier for unitizing a plurality of containers into a package having sleeve with a retainer portion formed with a plurality of container receiving openings arranged in three longitudinal rows. A plurality of containers are arranged within the sleeve and carried with two handles for supporting the package integrated with the retainer portion and positioned between each longitudinal row of containers. The handles, sleeve and retainer portion are each integrated together to form a single-piece carrier.

21 Claims, 4 Drawing Sheets

U.S. PATENT DOCUMENTS 5,305,877 A 4/1994 Olsen
5,311,984 A 5/1994 Harris
5,328,024 A 7/1994 Sutherland
5,360,104 A 11/1994 Sutherland
5,390,784 A 2/1995 Sutherland
5,425,446 A 6/1995 Weaver et al.
5,437,364 A * 8/1995 Broskow ..... 206/150
5,467,870 A * 11/1995 Broskow et al. ..... 206/162
5,487,463 A * 1/1996 Harris ..... 206/145
5,538,133 A 7/1996 Campbell et al.
5,544,749 A * 8/1996 Watts ..... 206/459.5
5,582,289 A 12/1996 Wright
5,590,776 A 1/1997 Galbierz et al.
5,653,334 A 8/1997 Marco
5,735,394 A * 4/1998 Harrelson ..... 206/151
6,032,791 A * 3/2000 Gresh, Jr. et al. ..... 206/150

* cited by examiner

TOP LIFT HANDLE CONTAINER CARRIER

This application is a continuation-in-part application of U.S. patent application Ser. No. 09/220,428, now U.S. Pat. No. 6,213,293, filed Dec. 24, 1998 and U.S. patent application Ser. No. 09/373,936, filed Aug. 17, 1999 now U.S. Pat. No. 6,145,656.

BACKGROUND OF THE INVENTION

1. Field of the Invention

This invention relates to a container carrier for unitizing a plurality of containers into a sleeve having a pair of handles extending between adjacent rows of container receiving openings.

2. Description of Related Art

Container carriers are often plastic ring carriers, commonly called "six-pack" rings, that unitize a plurality of containers into a single package. Cardboard, paperboard box carriers and plastic shrink wrap are also commonly used to unitize a plurality of containers.

The plastic ring carrier produces a unitized package for containers using little material. However, the plastic ring carrier, when used alone, has little or no advertising or promotional printing space. Conversely, the paperboard box carrier generally has a relatively large amount of area for promotional graphics. Disadvantageously, the paperboard box carrier requires a relatively large amount of material, may permit containers to fall out if it is not maintained in an upright position, and usually shrouds most or all of the actual containers. Therefore, there is a need for a package that incorporates the stability and economy of a ring carrier and the promotional area of a box carrier while maintaining the ease of portability of each.

SUMMARY OF THE INVENTION

It is one object of this invention to provide a container carrier that unitizes a plurality of containers into a tight, solid package that is easy to carry.

It is another object of this invention to provide a package having a pair of secure handles.

It is still another object of this invention to provide a container carrier that comprises a fully-integrated single piece construction.

A carrier for carrying a plurality of containers to create a package preferably comprises a single-piece device having a sleeve constructed from a flexible, resilient material such as plastic. A retainer portion forming a plurality of container receiving openings is integrated with the sleeve to form the carrier. Container receiving openings are preferably formed in three rows of four ranks.

The sleeve is additionally formed with handles to form the single-piece carrier. Preferably, the handles are integrated between longitudinal rows of container receiving openings. Each handle preferably extends parallel with respect to each other and perpendicularly from the retainer portion between rows of container receiving openings so that two handles are spaced one container receiving opening apart with respect to each other and spaced one container receiving opening from a longitudinal edge of the sleeve. In addition, each handle extends longitudinally at least as long as a length of two container receiving openings and preferably completely across a longitudinal length of the carrier.

The sleeve is applied to a plurality of containers to form a package. Containers may be arranged in an upper level and a lower level within the carrier or within only a single level of containers within the carrier.

As a result, the handles are preferably positioned between the first and second row of container receiving openings and between the second and third row of container receiving openings. The handles are of suitable size, shape and thickness to support the entire weight of package when each container is full.

In a method for manufacturing the carrier according to one preferred method of this invention, a plastic sheet substrate including the sleeve is printed with desired graphics and other merchandising information. The substrate is then folded along fold lines to isolate a single row of container receiving openings and two handles. The substrate is next formed with linear heat seals or other method of joining layers of plastic material, such as lamination, to form four seals longitudinally along the substrate.

The substrate is refolded along additional fold lines so that the sleeve is generally symmetric around a handle edge of the sleeve. Additional seals are then added close to each longitudinal edge of the sleeve. The carrier is then formed by cutting, such as in a punch press, the folded and sealed substrate to define the sleeve including the container receiving openings and handles.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
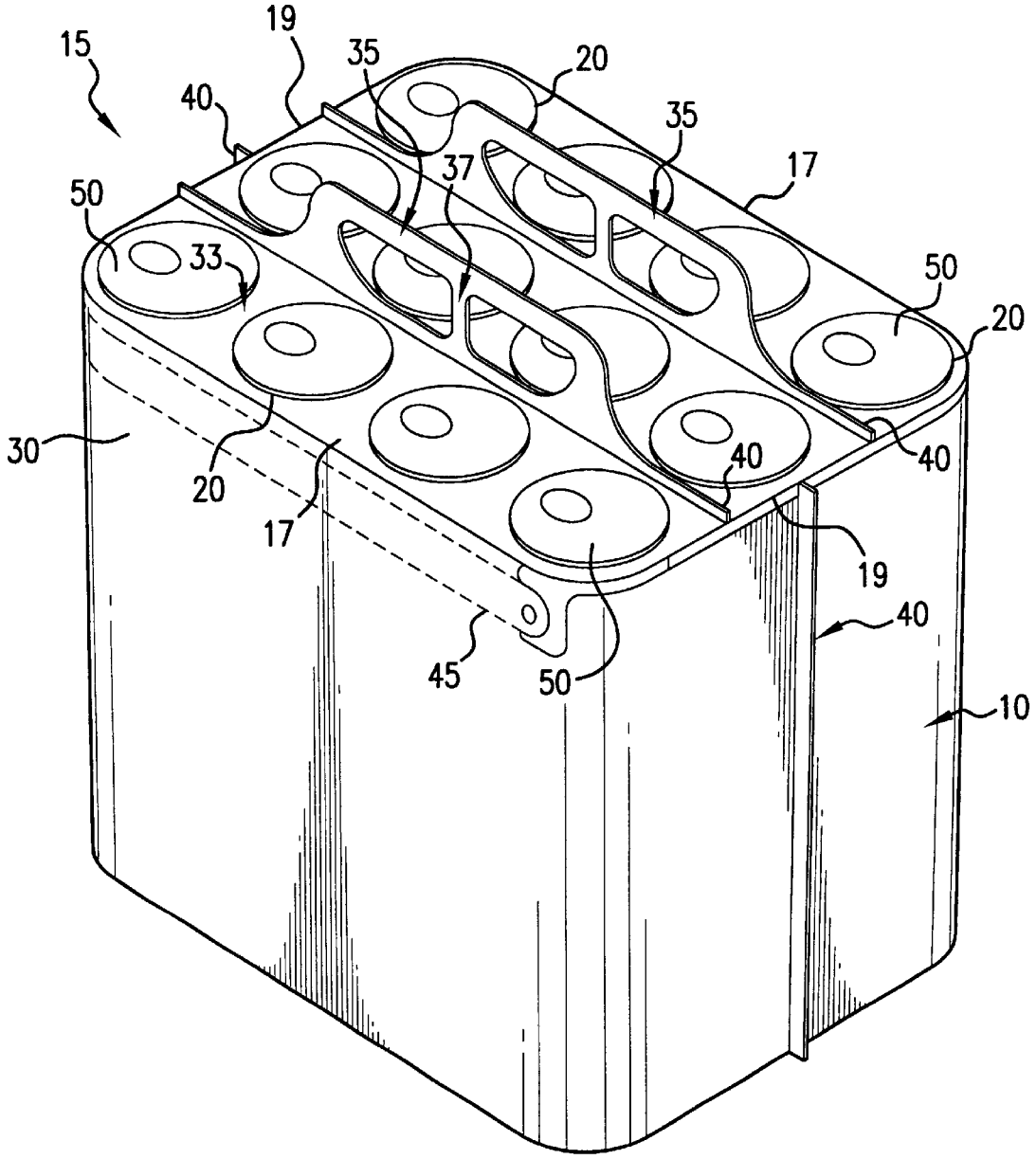
FIG. 1 is a front perspective view of a package of containers according to one preferred embodiment of this invention.
Figure 2:
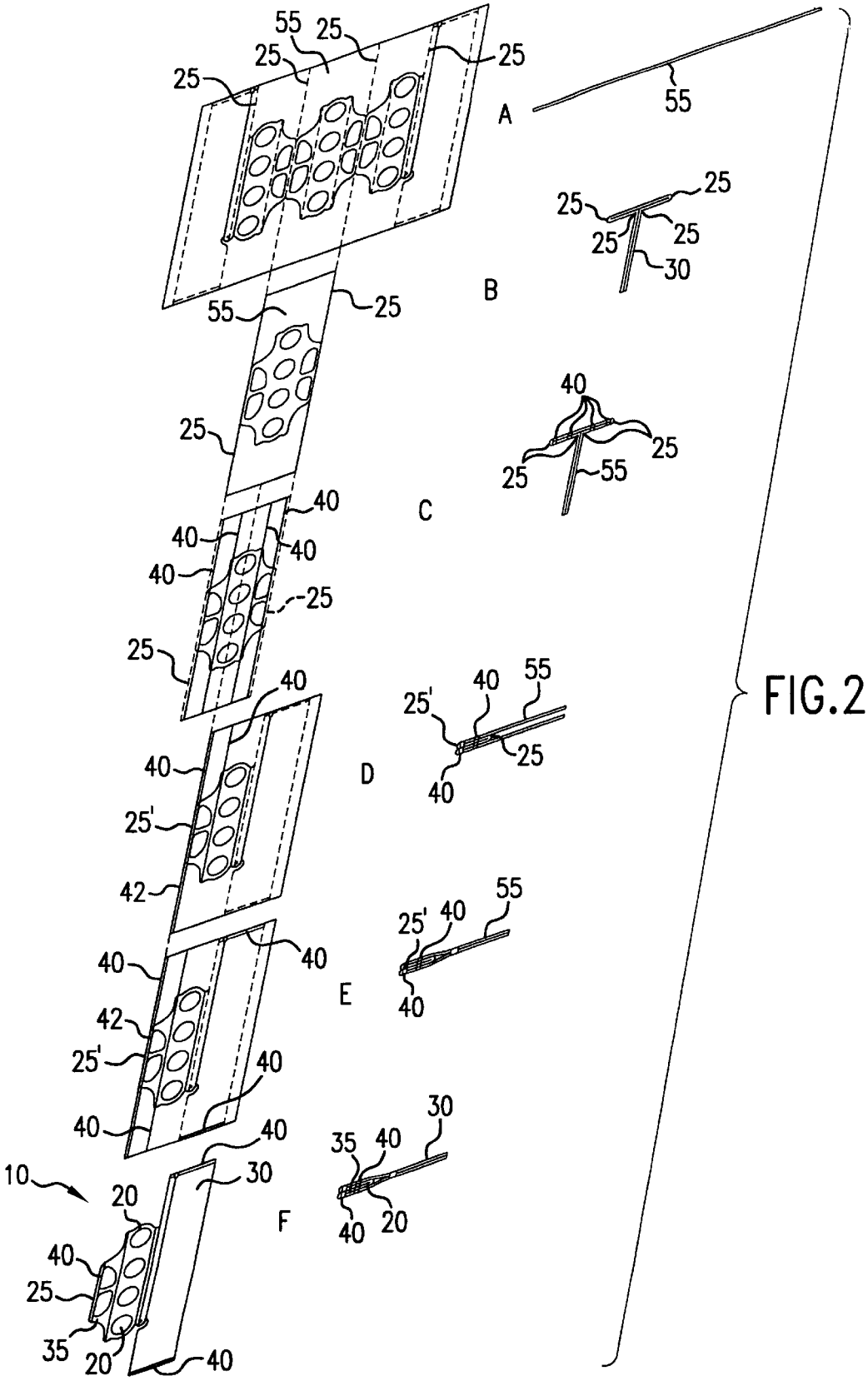
FIG. 2 is a schematic front and side view of a method for manufacturing a carrier according to one preferred embodiment of this invention.

FIGS. 1 and 2 show carrier 10 for carrying a plurality of containers 50 according to one preferred embodiment of this invention. Containers 50 as shown in FIG. 1 are preferably cans. Although cans are shown in FIG. 1, bottles or any other commonly unitized container 50 may be used with carrier 10 according to this invention. Containers 50 are preferably like-sized within a single carrier 10.

Carrier 10 unitizes a plurality of containers 50 to create package 15, such as package 15 shown in FIG. 1. Carrier 10 is preferably a single-piece device comprising sleeve 30 having a plurality of container receiving openings 20, preferably constructed from a flexible, resilient material such as plastic. For the purposes of this specification and claims, a sleeve is defined as a tubelike component capable of fitting over or around a plurality of containers 50. According to one preferred embodiment of this invention, retainer portion 33 forming the plurality of container receiving openings 20 is constructed from a low density polyethylene having a first thickness and sleeve 30 is constructed from a film having a second thickness, thinner than the first thickness. Alternatively, sleeve 30 and retainer portion 33 can be constructed from the same material having a constant thickness.

As discussed in additional detail below, carrier 10 is preferably cut, using means known to those skilled in the art such as a stamping die, to form a plurality of container receiving openings 20 in retainer portion 33 of sleeve 30. Two or more container receiving openings 20 are formed in retainer portion 33 of sleeve 30 in longitudinal rows and transverse ranks. In one preferred embodiment of this invention shown in FIGS. 1 and 2, container receiving openings 20 are configured in three rows of four ranks. Sleeve 30 may include other configurations of container receiving openings 20 depending on the size of package 15 desired.

Sleeve 30 is formed with handles 35 to form a single-piece carrier 10, as described in detail below. Handles 35 are preferably integrated within retainer portion 33 of sleeve 30. Handle 35 as used in the claims and specification is defined as a portion of carrier 10 made specifically to be grasped or held by the hand and which is capable of supporting the plurality of containers when full, i.e., at the point of purchase of package 15.

Alternatively, handles 35 may be glued or otherwise affixed to retainer portion 33 or retainer portion 33 may be formed with apertures or finger holes for grasping carrier 10. In a preferred embodiment of this invention, all containers 50 in an upper level of containers are substantially surrounded by container receiving openings 20 in retainer portion 33 to hold each container 50 in an upper level together relative to each other.

Handle 35 preferably has a same or similar thickness as retainer portion 33 and in one preferred embodiment of this invention, handle 35 has a greater thickness than sleeve 30. In one preferred embodiment of this invention, handles 35 are integrated between longitudinal rows of container receiving openings 20. Accordingly, one handle 35 is positioned on either side of the center row of container receiving openings 20 in a preferred embodiment of this invention having three rows of container receiving openings 20 integrated with sleeve 30.

Each handle 35 preferably extends perpendicularly from between rows of container receiving openings 20 so that the two handles 35 are spaced one container receiving opening 20 apart with respect to each other and spaced one container receiving opening 20 from longitudinal edge 17 of sleeve 30.

According to one preferred embodiment of this invention, each handle 35 extends longitudinally at least as long as a length of two container receiving openings 20. Preferably, each handle 35 extends completely across a longitudinal length of carrier 10 and parallel with respect to each other. Handle 35 should extend at least as long enough to accommodate a hand of a user.

According to one preferred embodiment of this invention, each handle 35 further includes a central supporting rib 37 extending between a portion of sleeve 30 and a central area of handle 35. Supporting rib 37 distributes the load of package 15 across handle 35 thereby preventing containers 50 from peeling out of retainer portion 33 and enabling handle 35 to support a heavier package 15 when in a fully loaded condition.

Sleeve 30 is preferably integrated with retainer portion 33 and container receiving openings 20 along at least two longitudinal edges 17 of retainer portion 33. According to an alternative embodiment of this invention sleeve 30 is also integrated with retainer portion 33 along two lateral edges 19 as well. Sleeve 30 is preferably printed with, on one or both sides, UPC and proof of purchase labels, graphics, and promotional and/or other information related to contents and/or ingredients of package 15. Sleeve 30 may additionally be at least partially transparent to effectively display nature of containers 50. Therefore, sleeve 30 serves the dual purposes of retaining containers 50 within a tightly assembled package 15 and advertising marketable features of the containers 50 and/or package 15.

Sleeve 30 is applied to a plurality of containers 50 to form package 15, shown in FIG. 1. Containers 50 are inserted within sleeve 30 which preferably bounds containers 50 around five sides of package 15. A sixth side, the top, of package 15 is engaged by retainer portion 33. Each container receiving opening 20 preferably engages container 50 around a chime or similar upper portion of container 50. The rigidity and elasticity of container receiving openings 20 within sleeve 30 support containers 50 within container receiving openings 20. A top portion of package 15 is therefore at least partially covered by retainer portion 33.

Package 15, shown in FIG. 1, includes a plurality of containers 50, such as a typical multipackage size of twenty-four cans as shown in FIG. 1. Containers 50 may be arranged in an upper level and a lower level within carrier 10 as shown in FIG. 1 or only a single level of containers 50 within carrier 10. A package according to one preferred embodiment of this invention will include an upper level of containers 50 removable from a lower level of container 50 while keeping the upper level of containers 50 integrated as a sub-package and permitting the lower level of containers 50 to be freely removable for individual consumption or storage.

According to one preferred embodiment of this invention, perforated tear strip 45 facilitates the efficient removal of the upper level of containers 50 and retainer portion 33 from the lower level of containers 50 and sleeve 30. In one preferred embodiment of this invention, perforated tear strip 45 is designed so a single pulling action circumferentially around package 15 will disassociate retainer portion 33 and upper level of containers 50 from a remainder of sleeve 30. Each container receiving opening 20 preferably engages a container 50 in the upper level of the plurality of containers 50. The lower level of containers 50 within carrier 10 are preferably seated on a bottom, or partial bottom, of sleeve 30.

As shown in FIG. 1, package 15 may contain tear strip 45 positioned within sleeve 30. Using an arrangement such as shown in FIG. 1, package 15 may be opened by pulling tear strip 45 across at least one side of package 15 thereby tearing open sleeve 30 to access containers 50. According to alternative embodiments of this invention, tear strip 45 may be positioned in other configurations that facilitate separation of containers 50 from package 15 and/or permit access to the lower level of the plurality of containers 50.

Containers 50 are positioned within package 15 so that sleeve 30 is flat and tight with respect to containers 50 and prominent with respect to package 15. Sleeve 30 is preferably sized to stretch when slid over a plurality of containers 50. Such a configuration of sleeve 30 results in package 15 having a prominent display area or "billboard" for advertising, information, graphics and other marketing material.

Handles 35, according to the preferred embodiment of this invention shown in FIG. 1, are positioned between the first and second row of container receiving openings 20 and between the second and third row of container receiving openings 20. Handles 35 are of suitable size, shape and thickness to support the entire weight of package 15 when each container 50 is full. Handles 35 preferably, though not necessarily extend longitudinally across package 15 and parallel with respect to each other. Alternatively, handles 35 may extend laterally across package 15 however in such an embodiment package 15 is more difficult to carry.

Figure 4:
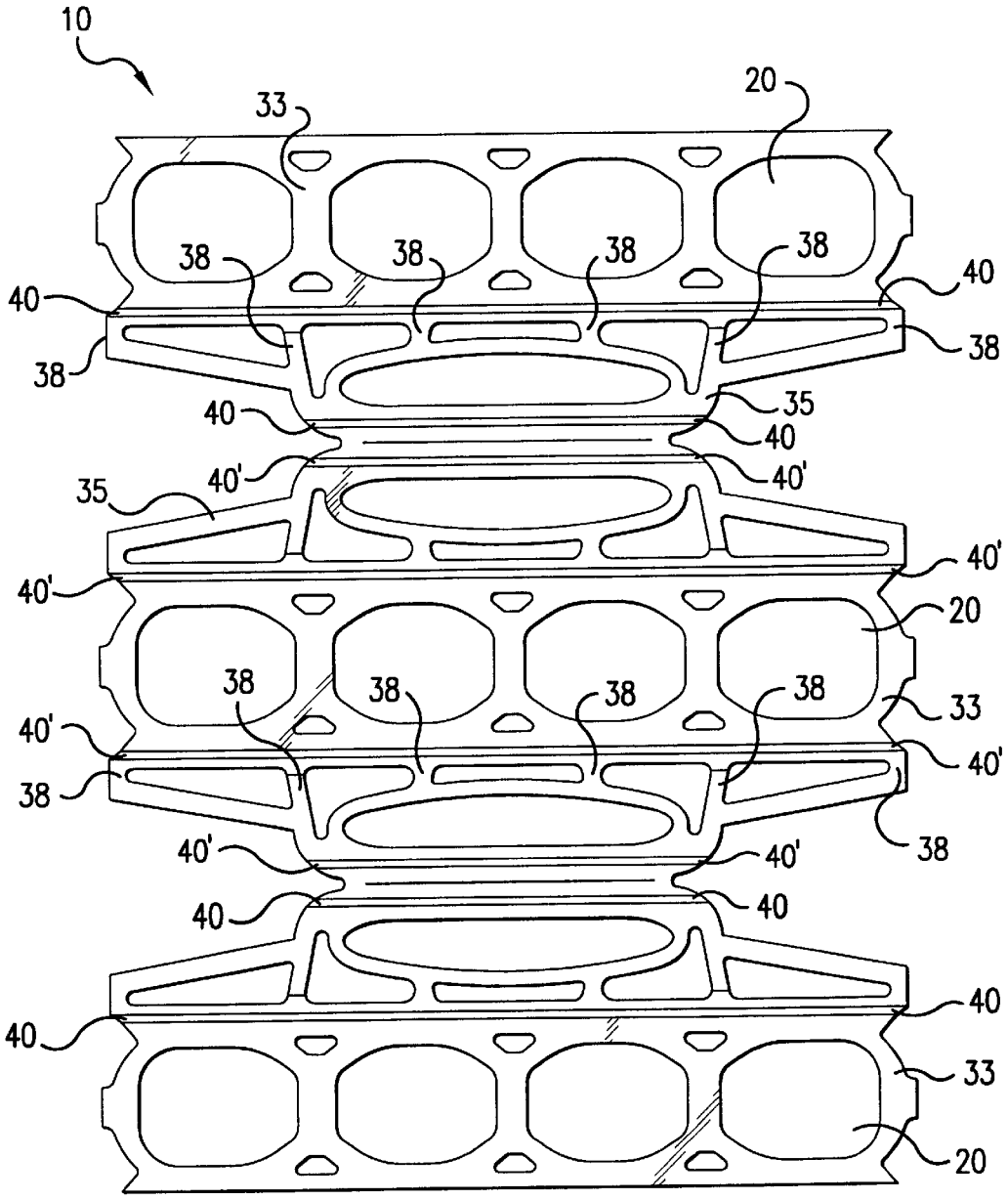
FIG. 4 is a top view of a carrier according to one preferred embodiment of this invention.

According to another preferred embodiment of this invention shown in FIG. 4, carrier 10 comprises retainer portion 33 having at least three rows of container receiving openings 20 and two handles 35 integrally formed with the retainer portion 33. FIG. 4 shows a pre-assembled view of carrier 10 before seams 40 and 40' are connected with respect to each other thereby creating two double-layer handles 35. As shown in FIG. 4, each handle 35 extends from between a row of container receiving openings 20 so that two handles 35 are spaced one container receiving opening 20 apart with respect to each other. Handles 35 preferably support the plurality of containers 50 without the need for sleeve around the plurality of containers 50. Each handle 35 preferably comprises a plurality of supporting ribs 38. When containers 50 are placed within container receiving openings 20, handles 35 preferably extend perpendicularly from between the rows of container receiving openings 20.

Figure 3:
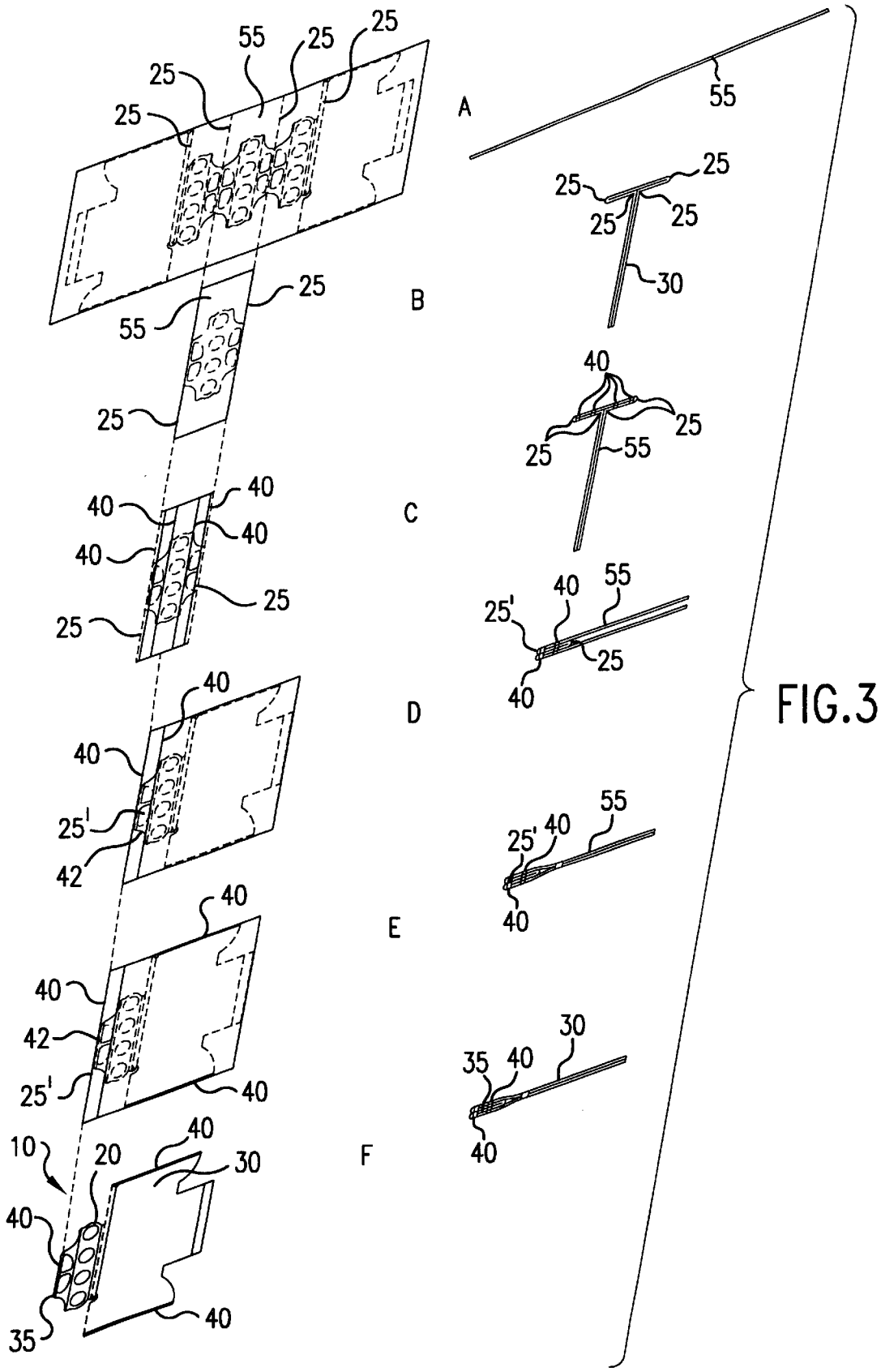
FIG. 3 is a schematic front and side view of a method for manufacturing a carrier according to another preferred embodiment of this invention.

FIGS. 2 and 3 show two methods for manufacturing carrier 10 according to two preferred methods of this invention. The method shown in FIGS. 2 and 3 demonstrate from top to bottom the assembly of various components of carrier 10, each step in the method designated by a letter of the alphabet. Each step of the method of manufacture includes a top perspective view and a side view of carrier 10 to demonstrate how a representative carrier 10 is folded along fold lines 25.

FIG. 2 shows a method for manufacturing carrier 10 for accommodating twelve containers 50. FIG. 3 shows a method for manufacturing carrier 10 for accommodating twenty-four containers 50.

FIGS. 2 and 3 show a method for manufacturing carrier 10 according to two preferred embodiments of this invention. In step [A], a plastic sheet substrate 55 including sleeve 30 is printed with desired graphics and other merchandising information.

As shown in step [B] of FIGS. 2 and 3, substrate 55 is folded along fold lines 25 to isolate a single row of container receiving openings and two handles 35. According to one preferred embodiment of this invention, a double layer of each handle 35 is formed within the folded arrangement of step [B]. In step [C], substrate 55 is formed with linear heat seals or other method of joining layers of plastic material to form four seals 40.

As shown in step [D] of FIGS. 2 and 3, substrate 55 is folded along a center fold line 25' as shown in the side view in FIGS. 2 and 3 so that sleeve 30 is generally symmetric around handle edge 42 of sleeve 30. In step [E], additional seals 40 are added in a manner similar to step [C] to close each longitudinal edge of sleeve 30.

In a final manufacturing step [F], carrier 10 is formed by cutting, such as in a punch press, the folded and sealed substrate 55 to define sleeve 30 and carrier 10. In addition, carriers 10 may be accumulated in a continuous strip by fan folding. Carriers 10 according to this invention, regardless of the method of manufacture, are not conducive to winding on reels because of the variable thickness formed by sleeve 30 in a folded state.

While in the foregoing specification this invention has been described in relation to certain preferred embodiments thereof, and many details have been set forth for purpose of illustration, it will be apparent to those skilled in the art that carrier 10 is susceptible to additional embodiments and that certain of the details described herein can be varied considerably without departing from the basic principles of the invention.

I claim:

1. A device for unitizing a plurality of containers within a sleeve comprising:

at least three rows of container receiving openings formed in a retainer portion integrated with the sleeve;

two handles integrally formed with the retainer portion, each handle extending from between two rows of container receiving openings so that the two handles are spaced one container receiving opening apart with respect to each other, each handle extending longitudinally across the retainer portion and perpendicularly from between each two longitudinal rows of containers and in a different plane from the retainer portion, each handle formed by two layers of material connected across at least one seam.

2. The device of claim 1 wherein each handle extends longitudinally at least as long as a length of two container receiving openings.

3. The device of claim 1 wherein each handle further comprises a central supporting rib.

4. The device of claim 1 wherein each handle is spaced one container receiving opening from a longitudinal edge of the sleeve.

5. The device of claim 1 wherein each handle extends completely across a longitudinal length of the device.

6. The device of claim 1 wherein the sleeve is closed along two oppositely positioned seams.

7. The device of claim 1 wherein the handle is folded in half along two corresponding symmetrical portions to form the two layers of material.

8. A package of a plurality of containers, the package comprising:

a retainer portion having a plurality of container receiving openings arranged in three longitudinal rows;

a plurality of containers arranged in an upper level and a lower level, each container receiving opening of the plurality of container receiving openings engaged with a container in the upper level of the plurality of containers;

a handle for supporting the package integrated with the retainer portion and positioned between each two longitudinal rows of containers, the handle integrated with the retainer portion and extending perpendicularly from between each two longitudinal rows of containers and in a different plane from the retainer portion, the handle formed by two layers of material connected across at least one seam; and a sleeve portion stretchingly engaged around the plurality of containers, the sleeve portion integrated with the retainer portion to form a single-piece carrier.

9. The package of claim 8 comprising two handles extending longitudinally across the package and parallel with respect to each other.

10. The package of claim 9 wherein the two handles are spaced one container receiving opening apart with respect to each other.

11. The package of claim 9 wherein the two handles are each spaced one container receiving opening from a respective longitudinal edge of the sleeve.

12. The package of claim 8 further comprising a tear strip positioned in the carrier sleeve for disassociating one or more containers in the upper level of the plurality of containers from the package.

13. A package of a plurality of containers, the package comprising:

a retainer portion having a plurality of container receiving openings arranged in longitudinal rows;

a plurality of containers arranged in an upper level and a lower level, each container receiving opening of the plurality of container receiving openings engaged with a container in the upper level of the plurality of containers;

a sleeve portion positioned around the plurality of containers, the sleeve portion integrated with the retainer portion to form a single-piece carrier;

a carrier tear line dividing the package into a separable upper level of the plurality of containers; and a handle integrated with the retainer portion and extending perpendicularly from between each two longitudinal rows of containers and in a different plane from the retainer portion, the handle formed by two layers of material connected across at least one seam and for supporting the package and the separable upper level of the plurality of containers.

14. A device for unitizing a plurality of containers comprising:

a retainer portion having at least three rows of container receiving openings; and two handles integrally formed with the retainer portion, each handle extending from between two rows of container receiving openings so that the two handles are spaced one container receiving opening apart with respect to each other, each handle extending across a longitudinal length of the device and perpendicularly from between the rows of container receiving openings and in a different plane from the retainer portion, each handle formed by two layers of material connected across at least one seam.

15. The device of claim 14 wherein each handle extends longitudinally at least as long as a length of two container receiving openings.

16. The device of claim 14 wherein each handle further comprises a plurality of supporting ribs connecting the handle with respect to the retainer portion.

17. The device of claim 14 wherein each handle comprises two layers of material connected across at least one seam.

18. The device of claim 17 wherein the two layers of material are connected along two seams to form each handle.

19. The device of claim 14 wherein each handle extends completely across a longitudinal length of the device.

20. The device of claim 14 wherein the container receiving openings are stretchable.

21. The device of claim 14 wherein the handle is folded in half along two corresponding symmetrical portions to form the two layers of material.

* * * * *